US005740008A

United States Patent [19]

Masuda et al.

[11] Patent Number: 5,740,008

[45] Date of Patent: Apr. 14, 1998

[54] CHARGING MEMBER AND DEVICE

[75] Inventors: Yoshitomo Masuda, Hamura; Yasushi Inoue, Kodaira; Takahiro Kawagoe; Shigeru Kijima, both of Tokorozawa; Yuko Maeda, Akishima, all of Japan

[73] Assignee: Bridgestone Corporation, Tokyo, Japan

[21] Appl. No.: 633,432

[22] Filed: Apr. 17, 1996

[30] Foreign Application Priority Data

Apr. 18, 1995 [JP] Japan ..... 7-092474
Aug. 30, 1995 [JP] Japan ..... 7-221797

[51] Int. Cl.[6] ..... G03G 15/00

[52] U.S. Cl. ..... 361/225

[58] Field of Search ..... 361/225, 230, 361/221; 399/168, 169, 174–176

[56] References Cited

U.S. PATENT DOCUMENTS 4,727,453 2/1988 Ewing ..... 361/225
5,008,706 4/1991 Ohmori et al. ..... 361/225
5,126,913 6/1992 Araya et al. ..... 361/225
5,144,368 9/1992 Ohzeki et al. ..... 355/219
5,235,386 8/1993 Yano et al. ..... 361/225
5,390,007 2/1995 Kugoh et al. ..... 361/225
5,475,472 12/1995 Saito et al. ..... 361/225
5,479,243 12/1995 Kurokawa et al. ..... 355/219
5,497,219 3/1996 Kurokawa et al. ..... 361/225
5,499,078 3/1996 Kurokawa et al. ..... 355/206
5,548,380 8/1996 Naka et al. ..... 355/219
5,602,712 2/1997 Daifuku et al. ..... 361/225

*Primary Examiner*—Fritz Fleming
*Attorney, Agent, or Firm*—Sughrue, Mion, Zinn, Macpeak & Seas, PLLC

[57] ABSTRACT

The invention provides a charging member for electrically charging an object by placing the member in contact with the object and applying voltage between them. The member includes a shaft and an elastic layer and a conductive layer successively formed around the shaft, and has a capacitance of up to $1\times10^{-9}$ F. and preferably a surface roughness of up to 20 μm on JIS ten point mean roughness scale. The charging member is effective for suppressing charging noise.

19 Claims, 1 Drawing Sheet

CHARGING MEMBER AND DEVICE

BACKGROUND OF THE INVENTION

1. Field of the Invention

This invention relates to a charging member and device for imparting electrical charge to an object, typically a photoconductor drum for use in electrophotography and electrostatic recording process, for example, copiers and printers.

2. Related Art

The conventional electrophotography as applied to copiers and printers involves the steps of uniformly charging a photoconductor on the surface, projecting an image from an optical system onto the photoconductor to form a latent image in an exposed area where the electric charge is erased, applying toner to the photoconductor to form a toner image, and transferring the toner image to a record medium, typically paper.

The first step of electrically charging the photoconductor typically employs a corona discharge system. The corona discharge system, however, is undesirable from the standpoint of safety and maintenance of the machine since it requires application of voltage as high as 6 to 10 kV. It also suffers from an environmental problem due to the emission of harmful substances such as ozone during corona discharge.

There is a need for an alternate charging system capable of charging at a lower applied voltage than the corona discharge and minimizing emission of ozone and other harmful substances. One exemplary alternative charging system is a contact charging system wherein a charging member having voltage applied thereto is brought in contact with an object to be charged, such as a photoconductor, thereby charging the object. Known charging members for use in the contact charging system include rollers which are based on rubber having conductive particles such as carbon dispersed therein and covered with a coating of nylon or the like having conductive inorganic oxide dispersed therein.

The contact charging system is, however, difficult to maintain a uniform charge potential in a stable manner. A method of overlapping AC voltage on the DC voltage for ensuring the uniformity of charge potential was proposed. Practical application of this method to commercial products has started.

Nevertheless, it was recently found that this method produces noise upon charging. Noise is not produced when only DC voltage is applied, but when AC is overlapped. Therefore, the currently available options are either applying DC voltage, which is effective for minimizing noise at the sacrifice of uniformity of charge potential, or overlapping AC on DC voltage which ensures stable uniformity of charge potential, but inevitably produces noise.

SUMMARY OF THE INVENTION

An object of the invention is to provide a charging member for use in forming a latent image in a copier or printer which member is capable of effectively charging an object in a silent manner, that is, with minimized charging noise.

We have found that by controlling the capacitance of a charging member below $1\times10^{-9}$ F, charging noise can be reduced, that is, silent charging can be performed.

According to the present invention, there is provided a charging member for electrically charging an object by placing the member in contact with the object and applying voltage between them. The member includes a shaft and an elastic layer and a conductive layer successively formed around the shaft and has a capacitance of up to $1\times10^{-9}$ F We have also found that by controlling the surface roughness of the charging member below 20 μm on JIS ten point mean surface roughness Rz scale, the charge potential is maintained uniform enough to produce satisfactory images.

We have further found that better results are obtained when a resin used in the conductive layer has a relative dielectric constant of up to 8; when a mixture of a resin and a conductive substance of which the conductive layer is made has a relative dielectric constant of up to 40 at a volume resistivity of $10^8$ Ω-cm; when the resin is an acrylic resin having a glass transition temperature of preferably −20° C. to 50° C., more preferably −10° C. to 35° C., most preferably −5° C. to 30° C.

The charging member may further include a coating on the outer periphery of the conductive layer. The coating is formed of a urethane-modified acrylic resin, fluoro-resin or nylon resin. The elastic layer is preferably formed of a foam.

The reason why charging noise can be reduced by using an acrylic resin in the conductive layer is not well understood, but presumed as below. According to our measurement, the acrylic resin has a considerably lower dielectric constant than urethane, nylon and other resins conventionally used in charging members. Since the lower dielectric constant suggests a lower capacitance, the electric attraction and reaction forces between the charging member and the photoconductor upon AC application are reduced. Consequently, charging noise is reduced.

Merely reducing charging noise is still unsatisfactory because the charging member is not practical if it can be cracked or stick to the photoconductor.

As opposed to the general recognition that acrylic resins are hard, it is important to select an acrylic resin having a glass transition temperature in the above-defined range. Acrylic resins having a higher glass transition temperature outside the range can be applied onto rollers to form coatings,, which will readily crack in a durability test and are thus impractical. Acrylic resins having a lower glass transition temperature outside the range are flexible, but tacky and thus impractical because their application to form a coating is difficult and free contact with the photoconductor is not expected. Only an acrylic resin having a glass transition temperature in the above-defined range provides the charging member with a conductive layer which has no tack, low hardness, and a flat surface.

DETAILED DESCRIPTION OF THE INVENTION

Figure 1:
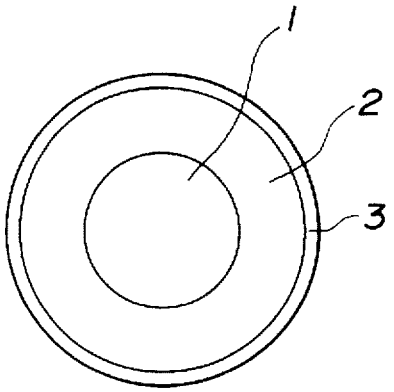
FIG. 1 is a cross-sectional view of a charging member according to one embodiment of the invention.

One of the problems to be solved by the invention is charging noise, which is described below. This problem is solved by adjusting the charging member so as to have a capacitance of up to $1\times10^{-9}$ F, preferably up to $8\times10^{-10}$ F, more preferably up to $6\times10^{-10}$ F.

In general, a capacitance C is represented by the following equation:

$$C=\epsilon_0\epsilon(S/d)$$

wherein $\epsilon$ is a relative dielectric constant, $\epsilon_0$ is a dielectric constant of vacuum, d is a thickness, and S is an area.

It is evident from this equation that for the purpose of reducing charging noise, a capacitance can be reduced by providing a lower dielectric constant, a larger thickness, and a smaller area. With this principle applied to a charging member, it is recommended that the charging member is made from a selected material having a minimal dielectric constant to a larger thickness so as to reduce the contact area.

In the case of a roller-shaped charging member, for example, from the thickness aspect, the capacitance can, of course, be reduced by increasing the roller diameter. However, the roller diameter is limited by the space available in the device to be loaded with the roller. In the case of a roller-shaped charging member having an outer layer in the form of a coating, it is possible to increase the thickness of the outer layer to reduce the capacitance of the charging member as a whole. The outer layer preferably has a thickness of at least 50 μm, more preferably at least 100 μm, most preferably at least 140 μm although the exact thickness varies with other parameters. The outer layer used herein corresponds to a conductive layer or a conductive layer having a coating if any in the context of the present invention.

With respect to the contact area, the actual contact area is meaningful. The actual contact area can be reduced by increasing surface roughness. This can be accomplished, for example, by adding particles to an outer layer to positively introduce roughness. Alternatively, when an outer layer is formed on a roller base from a coating composition, the roller base is swollen to positively introduce roughness.

The electrostatic capacitance of a charging member can be measured by means of an impedance analyzer or determined from electric measurement of the charging member combined with a metallic drum. The measurement by an impedance analyzer is carried out by abutting a charging roller against a highly conductive plate or drum of metal and connecting the impedance analyzer between the roller and the plate or drum, whereby the impedance analyzer calculates a capacitance.

The electric measurement of the charging member combined with a metallic drum is a measurement method based on a situation simulating the charging member that operates in a printer or copier. For example, a charging roller is placed in pressure contact with a metal drum and rotated therewith. With this setting, they are subject to selected voltage conditions. The selected voltage conditions are substantially the same conditions as the voltage actually applied in a printer or copier. In the case of an organic photoconductor (OPC) drum, for example, its charging potential is about −700 volts. This suggests that direct current of about 7 μA flows across the roller to make up the charge. By conducting direct current of this order across the metal drum, a DC resistance can be determined.

In some printers and copiers, AC is conducted in order to maintain the charging potential uniform. The AC conduction is under constant AC current control. By conducting alternating AC current across the metal drum, an impedance can be determined. If a parallel circuit model of a DC resistance component and a capacitance component is assumed as a roller circuit model, the capacitance value can be calculated by substituting the DC resistance value and the impedance value.

Another problem to be solved by the invention is a charging performance. This problem can be solved by adjusting the surface roughness of a charging member to 20 μm or less, preferably 10 μm or less, more preferably 6 μm or less on JIS ten point mean roughness Rz scale (JIS B 0601). This is contradictory to the above-mentioned approach of increasing the surface roughness of a charging member in order to reduce charging noise. Although the precise mechanism is not well understood, a charging member having practically acceptable charging capability and silence is advantageously obtained by adjusting its capacitance to $1\times10^{-9}$ F or less and its surface roughness to 20 μm or less on JIS ten point mean roughness Rz scale.

The charging member of the invention may have any desired shape insofar as it can contact the object to be charged. A choice may be made among various shapes including roller, blade and block shapes, with the roller shape being preferred.

Figure 2:
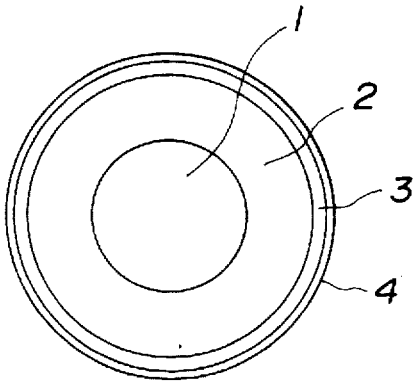
FIG. 2 is a cross-sectional view of a charging member according to another embodiment of the invention.

Referring to FIGS. 1 and 2, the charging member of the invention is illustrated as having a roller shape. The charging roller of FIG. 1 includes a cylindrical shaft 1, an annular elastic layer 2, and an annular conductive layer 3. The elastic layer 2 circumscribes the shaft 1 and the conductive layer 3 circumscribes the elastic layer 2. The charging roller of FIG. 2 further includes a coating 4 on the outer periphery of the conductive layer 3.

The shaft 1 may be made of metals and plastics.

The elastic layer 2 is preferably formed of polyurethanes, rubbers or foams thereof, especially polyurethane foams. A conductive agent such as carbon, metal oxides and ionic substances is added to the foam for imparting electrical conductivity thereto. The foam preferably has a density of 0.05 to 0.9 g/cm$^3$.

The conductive layer 3 is formed of a resin composition containing a resin and a conductive agent. The resin should preferably have a relative dielectric constant of up to 8, more preferably up to 7, most preferably up to 6. The resin is selected such that the resin composition may have a relative dielectric constant of up to 40, preferably up to 20 when it has a volume resistivity of $10^8$ Ω-cm. The relative dielectric constant at a volume resistivity of $10^8$ Ω-cm is defined herein as a representative since in general, a relative dielectric constant increases as conductivity increases.

Any desired resin may be used insofar as the above-mentioned requirement of dielectric constant is met although an acrylic resin is preferred. The acrylic resin should preferably have a glass transition temperature of −20° C. to 50° C. more preferably −10° C. to 35° C. most preferably −5° C. to 30° C. The acrylic resins include thermoplastic and crosslinking types while the crosslinking type is further classified into self-crosslinking, melamine crosslinking, and isocyanate crosslinking types. Any of these types may be used as long as it has a glass transition temperature in the above-defined range. Preferred from the standpoint of hardness which is a key factor in layer formation are thermoplastic acrylic resins, for example, "DIANAL" commercially available from Mitsubishi Rayon K.K.

The conductive agent which is added to the resin for imparting conductivity to the conductive layer 3 includes carbon, graphite and metal oxides. The conductive agent is added to the resin so that the resin composition may have a volume resistivity of $10^5$ to $10^{10}$ Ω-cm. Silica is added to the composition if desired.

The conductive layer preferably has a (radial) thickness of 50 to 400 μm although the thickness is not critical.

The conductive layer is typically formed by a dipping technique, that is, by preparing a resin composition in solution form and dipping the shaft with the elastic layer in the solution to form a coating thereon.

In the embodiment of FIG. 2, the coating 4 on the conductive layer 3 is preferably formed of a urethane-modified acrylic resin, fluoro-resin or nylon resin. The preferred nylon resin is a copolymeric nylon since it is least dependent on the environment. A conductive agent such as carbon, graphite and metal oxides is added to the resin for imparting conductivity to the coating. The conductive agent is added to the resin so that the resin composition may have a volume resistivity of $10^5$ to $10^{12}$ Ω-cm. Silica is added to the composition if desired. Although the thickness of the coating is not critical, it is preferably 1 to 30 μm so that the softness of acrylic resin is not lost. This ensures closer contact of the charging member with the photoconductor at high temperature.

There has been described a charging member having a controlled capacitance of up to $1\times10^{-9}$ F which is successful in reducing charging noise and ensures silent charging. When the charging member has a surface roughness of up to 20 μm on JIS ten point mean roughness Rz scale, it ensures a charging potential of enough uniformity to produce satisfactory images. The charging member is improved in charging noise and close contact with the photoconductor drum.

EXAMPLE

Examples of the invention are given below by way of illustration and not by way of limitation. All parts are by weight.

Example 1

A charging roller was prepared by forming a layer of conductive polyurethane foam having a blowing magnification of 2 around a metal shaft. The shaft with the foam layer was dipped in a coating solution which was prepared by dispersing 200 g of a urethane-modified acrylic resin EAU53B (Asia Industry K.K.), 257 g of 2-butanone, 23 g of carbon, and 24 g of silica in a Red Devil. There was obtained a charging roller having a coating layer of 250 μm thick.

The charging roller had a capacitance of $5.3\times10^{-10}$ F and a surface roughness of 3.5 μm on JIS ten point mean roughness. In a printing test using this roller, a charging noise of 66 dB was generated and satisfactory images were printed.

In the printing test, the roller was placed in pressure contact with an OPC drum and rotated therewith. A microphone connected to a noise meter was placed 3 cm apart from the contact between the roller and the drum. In this condition, a DC voltage of −700 V and an AC flow of 560 μA having a frequency of 500 Hz were applied in an overlapping manner, and charging noise was picked up by the microphone and measured by the noise meter.

The capacitance was determined by rotating the roller and the drum in pressure contact relationship, conducting a direct current of 7 μA between the roller and the drum, measuring the DC voltage, calculating a DC resistance therefrom, conducting an alternating current of 560 μA, measuring the AC voltage, calculating an AC resistance therefrom, and substituting them in an assumed parallel circuit model of a DC resistance component and a capacitance component for the roller.

Example 2

A charging roller was prepared by forming a layer of conductive polyurethane foam having a blowing magnification of 2 around a metal shaft. The shaft with the foam layer was dipped in a coating solution which was prepared by dispersing 200 g of a urethane-modified acrylic resin EAU53B (Asia Industry K.K.), 175 g of 2-butanone, 20 g of carbon, 10 g of a particulate acrylic resin MR50G having a particle size of 50 μm (Souken Chemical K.K.), and 24 g of silica in a Red Devil. There was obtained a charging roller having a coating layer of 60 μm thick.

The charging roller had a capacitance of $3.6\times10^{-10}$ F and a surface roughness of 17.5 μm on JIS ten point mean roughness. In a printing test using this roller, a charging noise of 65 dB was generated and satisfactory images were printed. The charging noise and capacitance were measured as in Example 1.

Example 3

A charging roller was prepared by forming a layer of polybutadiene rubber and liquid isoprene rubber around a metal shaft. The shaft with the rubber layer was dipped in a coating solution which was prepared by dispersing 200 g of an acrylic resin LR188 (Mitsubishi Rayon K.K.), 150 g of 2-butanone, 20 g of carbon, and 5 g of silica in a Red Devil. There was obtained a charging roller having a coating layer of 230 μm thick.

The charging roller had a capacitance of $9.2\times10^{-10}$ F and a surface roughness of 3.0 μm on JIS ten point mean roughness. In a printing test using this roller, a charging noise of 70 dB was generated and satisfactory images were printed. The charging noise and capacitance were measured as in Example 1.

Example 4

A charging roller was prepared by forming a layer of conductive polyurethane foam having a blowing magnification of 2 around a metal shaft. The shaft with the foam layer was dipped in a coating solution which was prepared by dispersing 200 g of a urethane-modified acrylic resin EAU53B (Asia Industry K.K.), 175 g of 2-butanone, 20 g of carbon, 10 g of a particulate acrylic resin MR90G having a particle size of 90 μm (Souken Chemical K.K.), and 24 g of silica in a Red Devil. There was obtained a charging roller having a coating layer of 60 μm thick.

The charging roller had a capacitance of $3.1\times10^{-10}$ F and a surface roughness of 35.6 μm on JIS ten point mean roughness. In a printing test using this roller, a charging noise of 67 dB was generated. Printed images were somewhat grained probably because of excessive surface asperities. The charging noise and capacitance were measured as in Example 1.

Comparative Example 1

A charging roller was prepared by forming a layer of polybutadiene rubber and liquid isoprene rubber around a metal shaft. The shaft with the rubber layer was dipped in a coating solution which was prepared by dispersing 200 g of an acrylic resin LR188 (Mitsubishi Rayon K.K.), 150 g of 2-butanone, 20 g of carbon, and 5 g of silica in a Red Devil. There was obtained a charging roller having a coating layer of 40 μm thick.

The charging roller had a capacitance of $2.1\times10^{-9}$ F and a surface roughness of 3.4 μm on JIS ten point mean roughness. In a printing test using this roller, a charging noise of 77 dB was generated and satisfactory images were printed. The charging noise and capacitance were measured as in Example 1.

Example 5

A urethane composition was prepared by mixing 100 parts of a polyether polyol having a molecular weight of 5,000 obtained by adding propylene oxide and ethylene oxide to glycerin, 25 parts of urethane-modified MDI, 2.5 parts of 1,4-butane diol, 1.5 parts of a silicone surfactant, 0.01 part of dibutyltin dilaurate, and 10 parts of carbon and agitating them in a whipper. The urethane composition was cast in a cylindrical mold having a metal shaft set therein. After curing, there was obtained a urethane foam roller.

A coating solution was prepared by adding carbon to an acrylic resin (DIANAL LR188, Mitsubishi Rayon K.K., glass transition temperature 20° C.) so that the resulting coating would have a volume resistivity of about $10^8$ Ω-cm. Note that the acrylic resin had a relative dielectric constant of 5.4 and the acrylic resin having carbon added thereto had a relative dielectric constant of 19.1 at a volume resistivity of $10^8$ Ω-cm. The urethane foam roller was dipped in this coating solution, forming a coating of 160 μm thick thereon.

The charging roller had a capacitance of $5.3\times10^{-10}$ F and a surface roughness of 3.3 μm on JIS ten point mean roughness.

The roller was placed in pressure contact with a photoconductor drum and rotated therewith. With a DC voltage of −0.7 kV, an AC voltage having a frequency of 500 Hz was applied in an overlapping manner so as to conduct an alternating current of 560 μA. A noise meter recorded a charging noise of 65.0 dB.

No sticking occurred when the roller was placed in pressure contact with the photoconductor drum at room temperature. Slight sticking to the drum occurred at 70° C.

Example 6

For forming coatings, a coating solution A was prepared by adding carbon to an acrylic resin (DIANAL LR188, Mitsubishi Rayon K.K., glass transition temperature 20° C.) so that the resulting coating would have a volume resistivity of about $10^8$ Ω-cm. Note that the acrylic resin had a relative dielectric constant of 5.4 and the acrylic resin having carbon added thereto had a relative dielectric constant of 19.1 at a volume resistivity of $10^8$ Ω-cm. Another coating solution B was prepared by adding carbon to a urethane-modified acrylic resin EAU53B (Asia Industry K.K.). The urethane foam roller (Example 4) was dipped in coating solution A and then in coating solution B to form an inner coating A of 160 μm thick and an outer coating B of 10 μm thick, completing a charging roller.

The charging roller had a capacitance of $6.1\times10^{-10}$ F and a surface roughness of 3.8 μm on JIS ten point mean roughness.

The roller was placed in pressure contact with a photoconductor drum and rotated therewith. With a DC voltage of −0.7 kV, an AC voltage having a frequency of 500 Hz was applied in an overlapping manner so as to conduct an alternating current of 560 μA. A noise meter recorded a charging noise of 66.0 dB.

No sticking occurred when the roller was placed in pressure contact with the photoconductor drum at room temperature. No sticking to the drum occurred even at 70° C.

Example 7

A coating solution was prepared by adding carbon to an acrylic resin (DIANAL LR882, Mitsubishi Rayon K.K., glass transition temperature −44° C.) so that the resulting coating would have a volume resistivity of about $10^8$ Ω-cm. Note that the acrylic resin had a relative dielectric constant of 5.9 and the acrylic resin having carbon added thereto had a relative dielectric constant of 21.0 at a volume resistivity of $10^8$ Ω-cm. The urethane foam roller (Example 4) was dipped in this coating solution, forming a coating of 160 μm thick thereon.

The charging roller had a capacitance of $5.8\times10^{-10}$ F and a surface roughness of 3.7 μm on JIS ten point mean roughness.

The roller was placed in pressure contact with a photoconductor drum and rotated therewith. With a DC voltage of −0.7 kV, an AC voltage having a frequency of 500 Hz was applied in an overlapping manner so as to conduct an alternating current of 560 μA. A noise meter recorded a charging noise of 66.5 dB.

After a long term operation, the roller became tacky and stuck to the photoconductor drum.

Example 8

A coating solution was prepared by adding carbon to an acrylic resin (DIANAL LR90, Mitsubishi Rayon K.K., glass transition temperature 85° C.) so that the resulting coating would have a volume resistivity of about $10^8$ Ω-cm. Note that the acrylic resin had a relative dielectric constant of 5.3 and the acrylic resin having carbon added thereto had a relative dielectric constant of 23.0 at a volume resistivity of $10^8$ Ω-cm. The urethane foam roller (Example 4) was dipped in this coating solution, forming a coating of 160 μm thick thereon.

The charging roller had a capacitance of $6.4\times10^{-10}$ F and a surface roughness of 2.8 μm on JIS ten point mean roughness.

The roller was placed in pressure contact with a photoconductor drum and rotated therewith. With a DC voltage of −0.7 kV, an AC voltage having a frequency of 500 Hz was applied in an overlapping manner so as to conduct an alternating current of 560 μA. A noise meter recorded a charging noise of 66.0 dB. However, the coating cracked during the test.

Comparative Example 2

A coating solution was prepared by adding carbon to a urethane resin so that the resulting coating would have a volume resistivity of about $10^8$ Ω-cm. Note that the urethane resin had a relative dielectric constant of 8.3 and the urethane resin having carbon added thereto had a relative dielectric constant of 51.2 at a volume resistivity of $10^8$ Ω-cm. The urethane foam roller (Example 4) was dipped in this coating solution, forming a coating of 160 μm thick thereon.

The charging roller had a capacitance of $1.9\times10^{-9}$ F and a surface roughness of 3.9 μm on JIS ten point mean roughness.

The roller was placed in pressure contact with a photoconductor drum and rotated therewith. With a DC voltage of −0.7 kV, an AC voltage having a frequency of 500 Hz was applied in an overlapping manner so as to conduct an alternating current of 560 μA. A noise meter recorded a charging noise of 78.1 dB. Sticking occurred when the roller was placed in pressure contact with the photoconductor drum at room temperature.

Comparative Example 3

A coating solution was prepared by adding carbon to a urethane-modified acrylic resin EAU65B (Asia Industry K.K.) so that the resulting coating would have a volume resistivity of about $10^8$ Ω-cm. Note that the urethane-modified acrylic resin had a relative dielectric constant of 8.9 and the acrylic resin having carbon added thereto had a relative dielectric constant of 61.1 at a volume resistivity of $10^8$ Ω-cm. The urethane foam roller (Example 4) was dipped in this coating solution, forming a coating of 160 μm thick thereon.

The charging roller had a capacitance of $2.2\times10^{-9}$ F and a surface roughness of 3.0 μm on JIS ten point mean roughness.

The roller was placed in pressure contact with a photoconductor drum and rotated therewith. With a DC voltage of −0.7 kV, an AC voltage having a frequency of 500 Hz was applied in an overlapping manner so as to conduct an alternating current of 560 μA. A noise meter recorded a charging noise of 79.0 dB. No sticking occurred when the roller was placed in pressure contact with the photoconductor drum at room temperature. Slight sticking to the drum occurred at 70° C.

Comparative Example 4

A coating solution was prepared by adding carbon to a urethane-modified acrylic resin EAU77B (Asia Industry K.K.) so that the resulting coating would have a volume resistivity of about $10^8$ Ω-cm. Note that the urethane-modified acrylic resin had a relative dielectric constant of 13.9 and the acrylic resin having carbon added thereto had a relative dielectric constant of 68.1 at a volume resistivity of $10^8$ Ω-cm. The urethane foam roller (Example 4) was dipped in this coating solution, forming a coating of 160 μm thick thereon.

The charging roller had a capacitance of $2.4\times10^{-9}$ F and a surface roughness of 3.4 μm on JIS ten point mean roughness.

The roller was placed in pressure contact with a photoconductor drum and rotated therewith. With a DC voltage of −0.7 kV, an AC voltage having a frequency of 500 Hz was applied in an overlapping manner so as to conduct an alternating current of 560 μA. A noise meter recorded a charging noise of 77.0 dB. Sticking occurred when the roller was placed in pressure contact with the photoconductor drum at room temperature.

Example 9

For forming coatings, a coating solution A was prepared by adding carbon to an acrylic resin (DIANAL LR188, Mitsubishi Rayon K.K., glass transition temperature 20° C.) so that the resulting, coating would have a volume resistivity of about $10^8$ Ω-cm. Note that the acrylic resin had a relative dielectric constant of 5.4 and the acrylic resin having carbon added thereto had a relative dielectric constant of 19.1 at a volume resistivity of $10^8$ Ω-cm. Another coating solution B was prepared by adding carbon to a fluoro-resin (LDW 40, Daikin Industry K.K.). The urethane foam roller (Example 5) was dipped in coating solution A and then in coating solution B to form an inner coating A of 160 μm thick and an outer coating B of 10 μm thick, completing a charging roller.

The charging roller had a capacitance of $6.5\times10^{-10}$ F and a surface roughness of 3.0 μm on JIS ten point mean roughness.

The roller was placed in pressure contact with a photoconductor drum and rotated therewith. With a DC voltage of −0.7 kV, an AC voltage having a frequency of 500 Hz was applied in an overlapping manner so as to conduct an alternating current of 560 μA. A noise meter recorded a charging noise of 66.0 dB.

No sticking occurred when the roller was placed in pressure contact with the photoconductor drum at room temperature. No sticking to the drum occurred even at 70° C.

Japanese Patent Application Nos. 92474/1995 and 221797/1995 are incorporated herein by reference.

Although some preferred embodiments have been described, many modifications and variations may be made thereto in the light of the above teachings. It is therefore to be understood that within the scope of the appended claims, the invention may be practiced otherwise than as specifically described.

We claim:

1. A charging member for electrically charging an object by placing the member in contact with the object and applying voltage between them, said member comprising a shaft and an elastic layer and a conductive layer successively formed around the shaft and having a capacitance of up to $1\times10^{-9}$ F., said conductive layer comprising a resin composition and a conductive substance, the resin composition having a relative dielectric constant of up to 40 when it has a volume resistivity of $10^8$ Ω-cm.

2. The charging member of claim 1 having a surface roughness of up to 20 μm on JIS ten point mean surface roughness Rz scale.

3. The charging member of claim 2, wherein the surface roughness is up to 10 μm on JIS ten point mean surface roughness Rz scale.

4. The charging member of claim 1 wherein the resin of said conductive layer has a relative dielectric constant of up to 8.

5. The charging member of claim 4 wherein the resin of said conductive layer is an acrylic resin having a glass transition temperature of −20° C. to 50° C.

6. The charging member of claim 4 wherein said conductive layer has formed on its outer periphery a coating comprising a urethane-modified acrylic resin, fluoro-resin or nylon resin.

7. The charging member of claim 1 wherein said elastic layer comprises a foam.

8. The charging member of claim 1, wherein the resin of said conductive layer is an acrylic resin having a glass transition temperature of −10° C. to 35° C.

9. The charging member of claim 1, wherein the resin of said conductive layer is an acrylic resin having a glass transition temperature of −5° C. to 30° C.

10. The charging member of claim 1, wherein said conductive layer has a capacitance of up to $8\times10^{-10}$ F.

11. The charging member of claim 1, wherein said conductive layer has a capacitance of up to $6\times10^{-10}$ F.

12. The charging member of claim 1, further comprising a coating formed on the outer periphery of said conductive layer.

13. The charging member of claim 12, wherein the thickness of said coating is increased to reduce a capacitance of the charging member.

14. The charging member of claim 13, wherein the thickness of said coating is at least 50 μm.

15. The charging member of claim 13, wherein the thickness of said coating is at least 100 μm.

16. The charging member of claim 13, wherein the thickness of said coating is at least 140 μm.

17. The charging member of claim 1, wherein said elastic layer comprises polyurethanes, rubbers or foams or a combination thereof.

18. The charging member of claim 1, wherein the thickness of said conductive layer is in the range of 50 to 400 μm.

19. A device for electrically charging an object, comprising a charging member adapted to be placed in contact with the object and means for applying voltage between the member and the object for electrically charging the object, said charging member comprising a shaft and an elastic layer and a conductive layer successively formed around the shaft and having a capacitance of up to $1\times10^{-9}$ F., said conductive layer comprising a resin composition and a conductive substance, the resin composition having a relative dielectric constant of up to 40 when it has a volume resistivity of $10^{8}$ Ω-cm.

* * * * *